US006164509A

United States Patent [19]

Gausling et al.

[11] Patent Number: 6,164,509

[45] Date of Patent: Dec. 26, 2000

[54] ERGONOMIC BOOKPACK

[75] Inventors: James F. Gausling; Stacey L. Moran, both of Hermosa Beach, Calif.

[73] Assignee: Zero g Technologies, LLC, Incline Village, Nev.

[21] Appl. No.: 09/357,522

[22] Filed: Jul. 19, 1999

[51] Int. Cl.[7] ..... A45F 3/04

[52] U.S. Cl. ..... 224/627; 224/153; 224/259; 224/631; 224/645

[58] Field of Search ..... 224/630, 259, 224/627, 631, 645, 153

[56] References Cited

U.S. PATENT DOCUMENTS

| | | | |
|---|---|---|---|
| 1,696,191 | 3/1928 | Coulson | 224/627 |
| 5,228,609 | 7/1993 | Gregory . | |
| 5,431,317 | 7/1995 | Kliot | 224/153 |
| 5,487,498 | 1/1996 | Gleason . | |
| 5,529,229 | 6/1996 | Fier . | |
| 5,676,293 | 10/1997 | Farris . | |
| 5,954,253 | 9/1999 | Swetish . | |
| 5,984,157 | 11/1999 | Swetish . | |
| 6,024,265 | 2/2000 | Clements . | |
| 6,053,382 | 4/2000 | Wyant | 224/153 |

OTHER PUBLICATIONS http://www.ebags.com/products/index.cfm?ModelID=1111&CategoryID=40&CFID=3371&CFTOKEN=68077143 p. 1.

http://www.ebags.com/products/index.cfm?ModelID=344&CategoryID=40&CFID=3371&CFTOKEN=68077143 p. 1–2.

http://www.ebags.com/products/index.cfm?ModelID=589&CategoryID=40&CFID=3371&CFTOKEN=68077143 p. 1.

http://www.ebags.com/products/index.cfm?fuseaction=image&ModelID=589&Sku=89560&view=bxlrg&CFID=3371&CFTOKEN=6807714 p. 1.

http://www.ebags.com/products/index.cfm?ModelID=592&CategoryID=40&CFID=3371&CFTOKEN=68077143 p. 1–2.

http://www.ebags.com/products/index.cfm?fuseaction=image&ModelID=592&Sku=89509&view=cxlrg&CFID=3371&CFTOKEN=6807714 p. 1.

http://www.ebags.com/products/index.cfm?ModelID=881&CategoryID=40&CFID=3371&CFTOKEN=68077143 p. 1–2.

http://www.ebags.com/products/index.cfm?ModelID=607&CategoryID=40&CFID=3371&CFTOKEN=68077143 p. 1.

http://www.ebags.com/products/index.cfm?ModelID=583&CategoryID=40&CFID=3371&CFTOKEN=68077143 p. 1–2.

http://www.ebags.com/products/index.cfm?ModelID=583&Sku=88584&view=bxlrg&CFID=3371&CFTOKEN=6807714 p. 1.

http://www.ebags.com/products/index.cfm?ModelID=293&CategoryID=40&CFID=3371&CFTOKEN=68077143 p. 1.

(List continued on next page.)

*Primary Examiner*—Stephen F. Gerrity
*Assistant Examiner*—Rhonda E. Sands
*Attorney, Agent, or Firm*—Morrison & Foerster LLP

[57] ABSTRACT

An ergonomic bookpack having an automatic suspension system is disclosed. A series of top straps, side straps, bottom straps and optional support members serve to move the bookpack center of gravity higher in the bookpack and closer to the wearer's body, significantly redistributing the load borne by the wearer's shoulders along a longer portion of the body and back. The body of the bookpack can be made so that the interior compartment of the bookpack body is transparent and the contents of the bookpack are visible to the human eye. The invention also comprises an optional yoke and lumbar pad. This bookpack of allows the wearer to bear heavier loads for a longer period of time with less fatigue, thus reducing the possibility of debilitating musculoskeletal difficulties.

20 Claims, 12 Drawing Sheets

OTHER PUBLICATIONS http://www.ebags.com/products/index.cfm?ModelID=274&CategoryID=40&CFID=3371&CFTOKEN=68077143 p. 1.

http://www.ebags.com/products/index.cfm?fuseaction=image&ModelID=444&Sku=497R&view=cxlrg&CFID=3371&CFTOKEN=6807714 p. 1.

http://www.ebags.com/products/index.cfm?ModelID=444&CategoryID=40&CFID=3371&CFTOKEN=68077143 p. 1–2.

http://www.ebags.com/products/index.cfm?ModelID=314&CategoryID=40&CFID=3371&CFTOKEN=68077143 p. 1.

http://www.ebags.com/products/index.cfm?fuseaction=image&ModelID=314&Sku=8124&view=dxlrg&CFID=3371&CFTOKEN=6807714 p. 1.

http://www.ebags.com/products/index.cfm?ModelID=315&CategoryID=40&CFID=3371&CFTOKEN=68077143 p. 1.

http://www.ebags.com/products/index.cfm?fuseaction=image&ModelID=315&Sku=8119&view=cxlrg&CFID=3371&CFTOKEN=6807714 p. 1.

http://www.ebags.com/products/index.cfm?ModelID=700&CategoryID=40&CFID=3371&CFTOKEN=68077143 p. 1.

http://www.ebags.com/products/index.cfm?fuseaction=image&ModelID=700&Sku=0749&view=bxlrg&CFID=3371&CFTOKEN=6807714 p. 1.

ERGONOMIC BOOKPACK

TECHNICAL FIELD

This invention is related to backpacks for day use. In particular, this invention is an ergonomically designed backpack in which the stresses presented to the wearer are minimized, allowing the wearer to carry heavier loads for a longer period of time with the least possible fatigue or discomfort.

BACKGROUND

The popularity of backpacks for day use has increased substantially in recent years. Not only are they widely used for day hiking, bicycling, and climbing, but these day packs are most prevalent among students for carrying books and supplies between their homes and school.

As national emphasis continues to be placed on improving schools and the quality of education afforded young people, many educational institutions are extending the length of the school day. Students are accordingly expected to be prepared for these longer days by carrying more books and supplies than they have in the past. Moreover, many school districts are extending the length of the school year; thus, students are not only carrying heavier loads but are doing so with increasing regularity.

Along with the heavier loads being carried more frequently by these frameless packs comes the increased potential for fatigue, discomfort, poor posture, and even musculoskeletal disorder and injury. This places a premium on backpack design to minimize such potential. However, the suspension systems in many such backpacks are simply incapable of providing an ergonomically correct fit.

What is needed is a day pack with a suspension system designed to maximizing wearer comfort and health, even when the pack is fully loaded.

SUMMARY OF THE INVENTION

This invention involves ergonomic improvements to backpacks or bookpacks worn by individuals for carrying cargo. According to one aspect of the invention, the ergonomic backpack comprises a backpack body having a top side, a bottom side, two lateral sides, a body side, and an outer side. The backpack also has at least two shoulder support members, each with a proximal end and a distal end. The proximal end is connected to the backpack body at a first juncture between the top side and the body side. The backpack also has at least one side support member disposed adjacent one of the lateral sides. This side support member has a proximal end connected to the backpack body at a second juncture between the outer side and one of the lateral sides, and a distal end connected to one of the shoulder support members.

One or more of the various sides may be at least partially transparent (via a mesh material or by comprising one or more straps).

The backpack may also have a bottom member with a proximal end connected to the backpack body at a third juncture between the backpack body outer side and bottom side, and two distal ends, each of which is connected to the distal end of each shoulder support member. Two such bottom members, each with a single distal end, may also be included instead of a single bottom member. At least one bottom support member connected to the backpack body bottom side at a proximal end and one of the bottom members at a distal end may also be included.

Likewise, the backpack may also have a top member with a proximal end that is connected to the backpack body at a fourth juncture between the backpack body top side and the outer side, and two distal ends, each of which is connected to one of each of the shoulder support members. Two such top members, each with a single distal end, may also be included instead of a single top member. A top support member connected to the backpack body top side at a proximal end and one of the top member at a distal end may also be included.

A lumbar support member may be disposed adjacent the body side of the backpack body. In addition, a yoke may be disposed along the backpack body at the first juncture and connected to each shoulder strap.

According to another aspect of the invention, an ergonomic bookpack is provided comprising a backpack body having a top side, a bottom side, two lateral sides, a body side, and an outer side. At least two shoulder support members are also provided, each with a proximal end and a distal end. The proximal end is connected to the backpack body at a first juncture between the top side and the body side. The backpack also has at least one side support member disposed adjacent one of the lateral sides. This side support member has a proximal end connected to the backpack body at a second juncture between the outer side and one of the lateral sides and a distal end connected to one of the shoulder support members. The backpack also comprises at least one bottom member with a proximal end connected to the backpack body at a third juncture between the backpack body outer side and bottom side, and at least one distal end connected to the distal end of one of the shoulder support members.

One or more of the various sides can be at least partially transparent. In addition, the bottom side may have a higher stiffness than the top side, the two lateral sides, the body side, and the outer side.

According to yet another aspect of the invention, an ergonomic backpack is provided comprising a backpack body having an interior compartment, a top side, a bottom side, two lateral sides, a body side, and an outer side. The backpack also has a pair of shoulder straps, each with a distal end and a proximal end. The proximal end is connected to the backpack body at a first juncture between the top side and the body side. The backpack also includes a pair of side straps, each of which is disposed adjacent one of the lateral sides. Each side strap has a proximal end connected to the backpack body at a second juncture between one of the lateral sides and the outer side, and a distal end connected to one of the shoulder support members. The backpack includes a pair of bottom straps, each of which has a proximal end connected to the backpack body at a third juncture between the outer side and the bottom side and a distal end connected to each of the shoulder strap distal ends. Each bottom strap is at least partially disposed adjacent the bottom side. At least one bottom support strap having a proximal end connected to the bottom side of the backpack body and a distal end connected to one of the bottom straps is also included. A pair of top straps, each with a proximal end connected to the backpack body at a fourth juncture between the top side and the outer side and a distal end connected to each of the shoulder support straps is a part of this aspect of the invention. Finally, the backpack comprises at least one top support strap having a proximal end connected to the backpack body top side and a distal end connected to one of the top straps as well as a lumbar support member disposed adjacent the body side. When items are placed into the interior compartment, they may be visible to the human eye.

DESCRIPTION OF THE INVENTION

Figure 1:
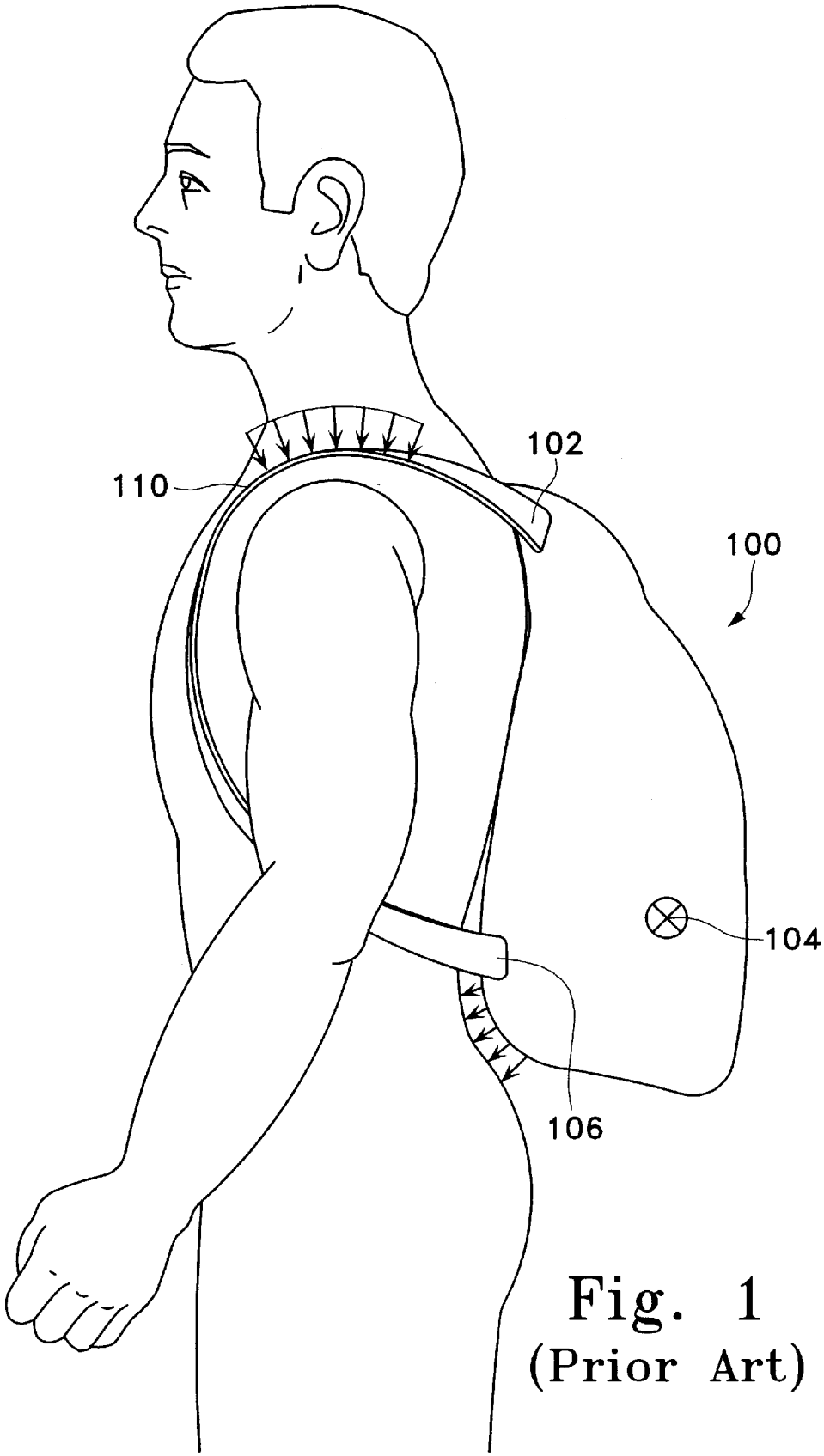
Fig. 1 (Prior Art)
FIG. 1 is a side view of a conventional bookpack shown as worn.

Turning now to the figures, where like references refer to like elements, a model wearing a conventional bookpack is shown in FIG. 1 in side view. For purposes of illustration, pack body 100 is assumed to be moderately loaded with cargo, such as books, school supplies, and the like.

Backpack body 100 is connected to a pair of shoulder straps 110, each of which is affixed to body 100. In FIG. 1, one such strap 110 is shown attached to body 100 at point 102.

The bookpack's center of gravity (CG), illustratively located in FIG. 1 at a position marked by reference numeral 104, tends to be far behind the wearer's back and low in the backpack body. Such a position is manifested by the sagging appearance of the backpack body 100.

The moment produced by the weight of the bookpack 100 with this support configuration is in a direction such that a force is produced toward the body at position 106 and a force away from the wearer's body at point 102.

This configuration creates the large limited load distribution depicted in FIG. 1 over a relatively small portion of the wearer's body where the shoulder strap 110 meets the wearer's shoulder. It also causes point 106 to act as a sort of hinge or pivot point, causing the backpack body 100 to impinge on the wearer's back as shown near point 106. Nearly all of the forces and moments caused by the bookpack weight are reacted at point 102, through the top portion of strap 110. As illustrated in FIG. 1, these forces pull the pack 100 out at the top and away from the wearer's body causing the shoulders to be pulled back. The weight is distributed across a disproportionately small section of the shoulder straps directly on top of the wearer's shoulders. It also forces the shoulder straps under the arm to ride up and pinch under the wearer's arms.

Anyone who has seen a student walking across campus with a full bookpack, hunched over and with their thumbs holding the shoulder straps out off their chests has witnessed this effect. Such a configuration causes unnecessary fatigue, discomfort, and the possibility of long-term musculoskeletal difficulties.

In contrast, the bookpack of the present invention remedies the problems caused by typical bookpacks such as that shown in FIG. 1. One embodiment of the present invention is shown in FIGS. 2–7 and 9.

Figure 2:
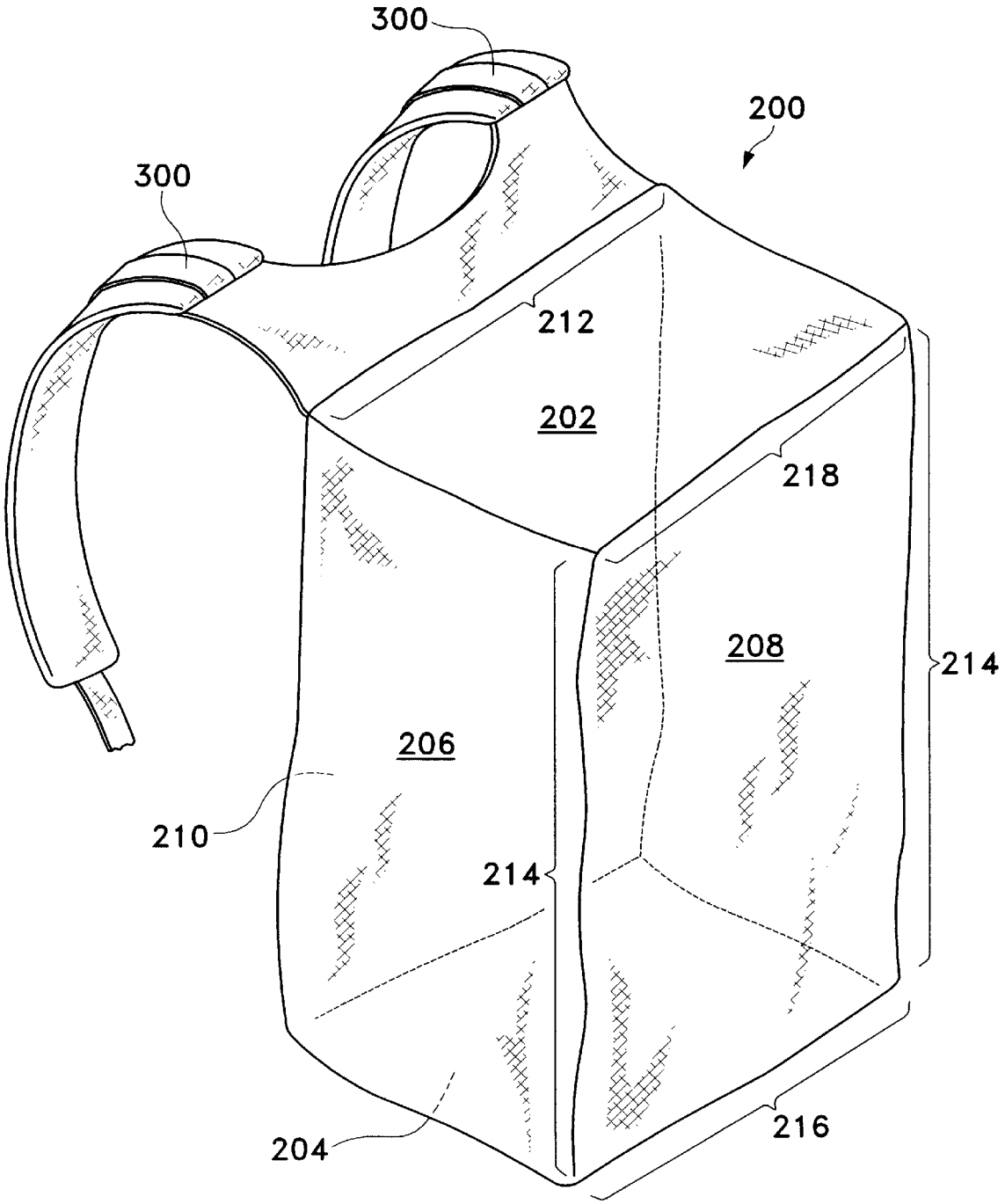
FIG. 2 is a simplified perspective view of the bookpack of the present invention detailing the bookpack body without the features of the automatic suspension system.

A simplified backpack body 200 of the present invention is formed by a number of panels or sides as shown in FIG. 2 without a number of the inventive features so that the underlying components and numbering conventions can be first described.

Bookpack body 200 has a top side or region 202, a bottom side or region 204, two lateral sides or regions 206, an outer side or region 208, and a body side or region 210. When connected, these six panel regions define an interior compartment in body 200 into which cargo such as books, food, clothing, etc. may be stowed. Of course, this region may be subdivided into or complemented with a number of additional compartments or regions for keeping various items separate (facilitating organization, ease of ready access to frequently used items such as keys or water bottles, and allowing for the proper weight distribution and comfort to the wearer).

The particular six-panel configuration herein described serves two primary purposes. First, it provides a convention by which the features of the invention can be described and the relationships among the various components can be shown. Second, it is a simple and graphic way to depict the general shape of bookpack body 200 when loaded with cargo, and corresponds to the principal views any generic cubic or rectangular three-dimensional body presents to an observer (top, bottom, and four sides).

Although six particular sides or panels are described, bookpack body 200 can comprise fewer panels or sides, and have correspondingly fewer seams or junctures, and be within the scope of the invention. For instance, in an extreme example, a configuration in which each of the body, top, bottom, outer, and lateral sides are comprised of one continuous piece of fabric with no actual seams or junctures is within the scope of the present invention. In such a case, one may still describe the body 200 as having a number of seams or junctures simply to aid the reader in understanding the relative location on the body 200 being discussed. On the other hand, and at the other end of the spectrum, a configuration in which as many as ten or more panels or sides and corresponding seams or junctures is contemplated as well.

Separating the various panels or side regions described above are a series of junctures or seams. For instance, a first juncture 212 is defined between top panel 202 and body side 210. Second seams or junctures 214 are similarly disposed along lines or region between the outer side 208 and the two lateral sides 206. A third juncture or seam 216 defines a transition region between the bottom panel 204 and the outer side 208, and a fourth juncture or seam 218 is disposed generally between the outer side 208 and the top panel or side 202.

These various seams or junctures are described herein strictly to assist the reader in understanding the construction of the various embodiments of the invention and the locations of various attachment points for components thereof.

In addition, the description of the various junctures is meant to define a region as opposed to a specific location on body 200. Therefore, when for example a first juncture 212 between top side 202 and body side 210 is described, it is expressly meant only to define a general region of transition between these two sides 202 and 210. This means that one may move as many as several inches away from the first juncture 212 into the region of the top side 202 or body side 210, or anywhere along the line shown in the figures as defining these junctures, and still be within the scope of what we intend the meaning of the term "seam" or "juncture" to cover. Accordingly, when the various support members and straps of the present invention are discussed as connected to the backpack at or disposed along the various junctures, it is understood that the point of connection or disposal is in a region at or near the particular juncture or seam; the connection point need not be exactly on that juncture or seam.

With this in mind, junctures or seams can comprise a general transition region in backpack body from one section to another without any discontinuity in the panel or side. For instance, first juncture 212 between the top side 202 and the body side 210 can generally define a region where, when body 200 is loaded with contents, the panels or sides transition from one orientation to another; in other words, the first juncture 212 is merely a bend in the backpack body 200.

Alternatively, continuing to use the first juncture 212 example, seam 212 can be permanent, such as a line of sewing or other type of permanent bonding or fusing of the two sides, or it can be a temporary seam along or near which a body compartment can be opened and closed. In the latter case, first juncture or seam 212 can represent an area near a Nylon or metal zipper, a hook and loop-type fastener, snaps, buttons, and the like. These options described above for juncture 212 applies, of course, to all the junctures herein described.

The discussion and designation of the various components of body 200 shown in FIG. 2, including the panels or sides and their corresponding seams as described below, are simplified so that the advantages of the present invention can be particularly described. For instance, it is within the scope of the invention that although body 200 defines a compartment into which cargo such as books, clothing, food, etc. may be placed, additional compartments and features such as outer and side compartments, loops, daisy chains, etc. may be added to the backpack body 200.

The panels making up backpack body 200, as well as the straps and other components of the invention can variously comprise a number of natural or synthetic materials. Natural fabric such as leather, cotton (especially canvas or single-filled duck) and the like may be useful for certain applications. Preferred are synthetic fabrics made from thermoplastic materials such as polypropylene, polyvinyl, polyamide (such as Nylon), polyethylene, polyester, etc. We have found 0.005 inch-thick polypropylene fabric to be useful. Especially preferred is Nylon which can be textured for breathability, wear-resistance, and waterproofed with materials such as silicone elastomers and the like. Particularly useful is a type of Nylon known as CORDURA (E.I. du Pont de Nemours & Co., Wilmington, Del.). Multiple or composite layer configurations as are well-known in the art, in which a tougher, more durable weave comprises an outer layer while a lighter, thinner, and more flexible inner weave comprises an inner layer. Some of these materials known in the industry, such as GORE-TEX (W.L. Gore & Associates, Newark, Del.), TRI-SHFIELD (Tri-Seal International, Blauvelt, N.Y.), SPANDURA (H. Warsaw & Sons, New York, N.Y.), etc. can be used as appropriate.

We have found that when using the above materials in fibrous form, finenesses in the range from 75 denier to 2000 denier are possible. Preferred are fibers in the range of 500 denier to 1050 denier; especially preferred is 1000 denier. Various thicknesses of fabric can be used as appropriate. In addition, for the different support members or straps variously described herein, widths of anywhere from 0.25 inch to over 3 inches or more are contemplated; preferred are 0.5 inch to 1.0 inch widths.

A pair of shoulder support members, or straps 300, are shown in FIGS. 2–9. Each strap 300 has a proximal end 310 and a distal end 320. Support member proximal end 310 is connected to pack 200 at first juncture 212 via optional yoke 340. Alternatively, proximal end 310 can directly connect to pack 200 at first juncture 212 without the presence of yoke 340. In either configuration, each proximal end 310 of shoulder support member 300 is attached to first seam 212 by stitching, etc. as is well-known in the art. Shoulder support member 300 can be complemented with padding and adjustment straps (as more clearly shown in FIG. 6), sternum straps connecting each shoulder strap 300 (not shown), etc., as necessary to ensure proper comfort and functionality of the overall design.

Turning now to lateral or side panels 206, a side support member or strap 400 is shown in FIGS. 3–9 as disposed adjacent each side panel 206.

Figure 3:
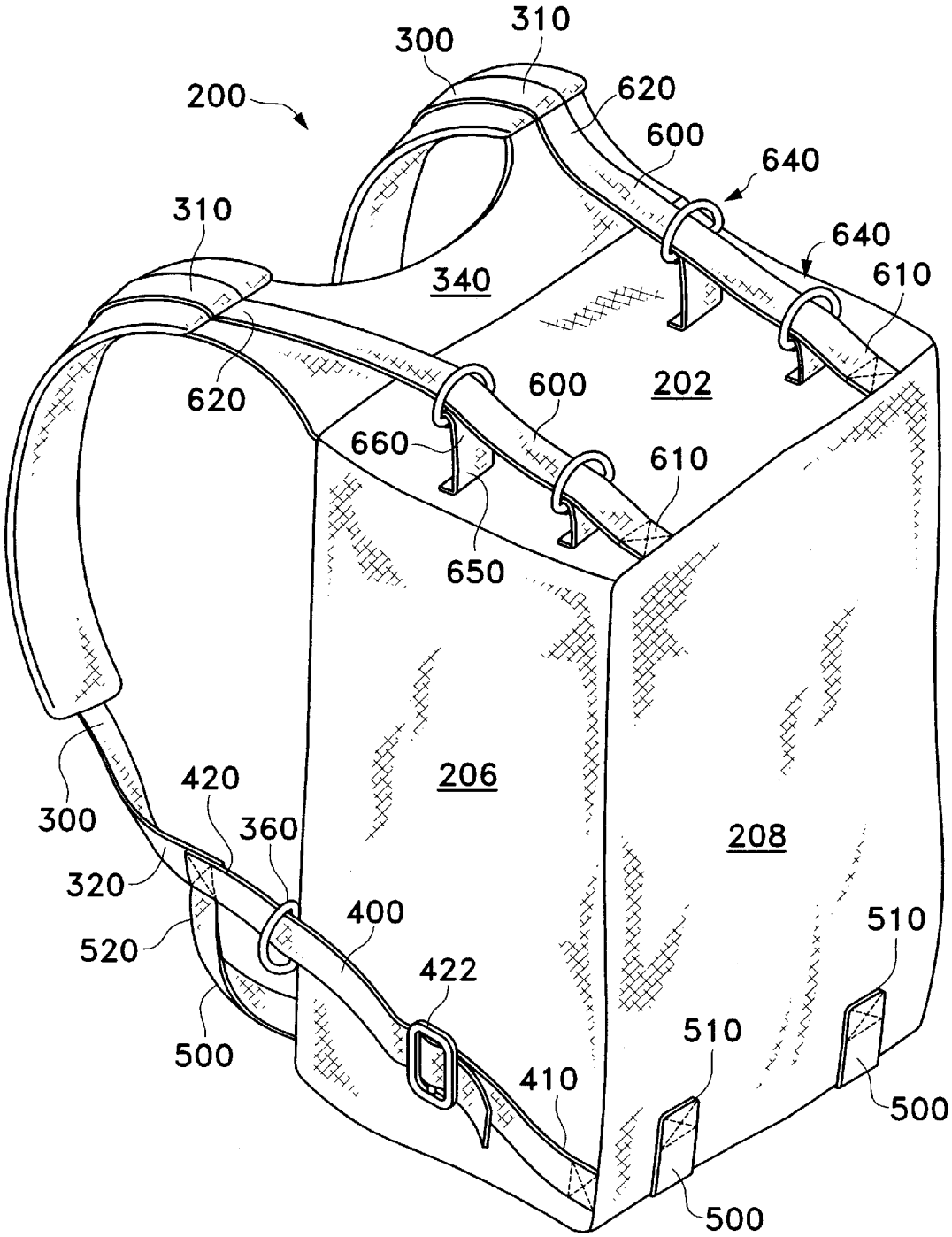
FIG. 3 is an perspective view of the bookpack of the present invention detailing the features of the automatic suspension system.

Each side support member 400 has a proximal end 410 and a distal end 420. As best shown in FIG. 3, the side member proximal end 410 is affixed to body 200 at the second juncture or seam 214 appropriate for the side of the bookpack body 200 on which side strap 400 is disposed. Although we prefer that side strap 400 attach to body 200 close to the bottom of the body as shown in the figures, side support member 400 can be attached to body 200 up to several inches or more above the bottom of body 200 along the length of second seam or juncture 214.

Side support member 400 is preferably disposed along lateral or side panels 206. As will be discussed later, such a configuration allows the side strap 400 to redistribute the load borne by the wearer of the backpack more evenly across the wearer's back and along the shoulder straps 300.

Side support member distal end 420 is shown in FIG. 3 as connected to the distal end 320 of shoulder support member 300, permanently (e.g., by stitching as shown in FIG. 3) or releasably (such as by a hook and loop type fastener, an adjustable buckle, or the like). The shoulder strap 300 and side strap 400 distal ends cam be connected so to form the appearance of a continuous strap.

Side support member 400 can be optionally threaded through a D-ring 360 as shown in FIG. 3. By slidingly engaging strap 400, D-ring 360 helps to keep side strap 400 close to side panel 206, aligns the strap 400 for connection to the shoulder strap 300, and provides stress relief by allowing side strap 400 to move in response to shifting loads.

An optional adjustable Nylon or metal buckle 422 or the like is shown in FIG. 3 intermediately disposed between side strap 400 proximal and distal ends. Technically, such a buckle or device may require side strap 400 to actually comprise two strap sections; it is understood that when discussing the proximal and distal end of side strap 400 (or any strap herein), any multiple strap pieces are considered together with any buckle or the like to form a unitary component having a single proximal end and a single distal end.

By allowing the effective length of side strap 400 to be lengthened or shortened, buckle 422 serves not only to directly adjust the load distribution borne by the wearer by pulling in or letting out the shoulder strap 300 via its distal end 320, but it also allows the side straps 400 to act as compression straps, adjusting the shape of the bookpack body 200 via compression or expansion of lateral or side panels 206.

As long as the proximal end 410 of side strap 400 is connected to the body of bag 200 in the vicinity of second juncture 214, or even some distance as far as two to three inches or more in any direction away from such seam 214, various adjustment and fastening configurations and designs, such as described above and as are well known in the art, are within the scope of the invention.

Another feature of the present invention that provides added support and ergonomic utility to the backpack is a rigid pack body bottom side 204. As will be seen, such a characteristic serves to keep the bookpack body 200 square, lifting and compressing the load towards the wearer's body and shoulders.

Although there are a variety of ways in which the bottom of pack body 200 can be made rigid, two are particularly attractive.

The first involves utilizing a stiffer material for bottom panel 204 than the material used for the rest of the backpack body 200. By using the term stiffness with respect to bottom side 204, we mean, singly or in combination, the elastic modulus in the three principal directions (tension, bending, and shear) as well as the overall rigidity of the bottom side 204 when considered by a layperson.

For instance, bottom panel 204 can comprise a thicker layer of Nylon, polyurethane, polyallomer, etc., increasing the bottom side's stiffness relative to the other five panels of body 200. This can also be accomplished by fabricating the bottom panel 204 as a composite, such that various layers of material having dissimilar mechanical properties make up bottom panel 204, or by inserting a rigid member (such as a hard Nylon sheet) inside a pocket formed by bottom panel 204, etc.

For instance, a relatively thick layer of polyurethane or abrasion-resistant Nylon, ranging in thickness from a few millimeters to several centimeters or more, can be bonded or otherwise affixed to the outside of bottom panel 204. This serves not only to increase the rigidity of the bottom panel 204, but also serves to protect the bottom panel 204 from wear and abrasion as the backpack is most typically placed on the ground, etc. on the bottom panel 204. Such a layer can be grooved or otherwise molded or shaped, etc. to facilitate non-skidding and to allow the backpack to be self-standing.

Another method for increasing the stiffness of the bottom panel 240, useable singly or in combination with any of the features described above, is by adding one or more bottom straps or members 500. FIGS. 3–4, 4A, and 6–9 show a configuration in which two such bottom straps 500 are used.

Here, a proximal end or region 510 of each bottom strap 500 is connected to the body 200 on or near a third juncture or seam 216 defined at the intersection of outer side 208 and bottom side 204. Each bottom member 500 preferably is disposed adjacent bottom panel 204 and connects at its distal end 520 to the right or left shoulder strap distal end 320 or side strap distal end 420, or both, in the general vicinity of their intersection as shown in FIG. 3. Again, such connection points for both the proximal and distal ends of these bottom members 500 can be widely varied to serve the purposes which suit the particular design, and the invention is not so limited to the precise connection locations shown in the figures.

Figure 3A:
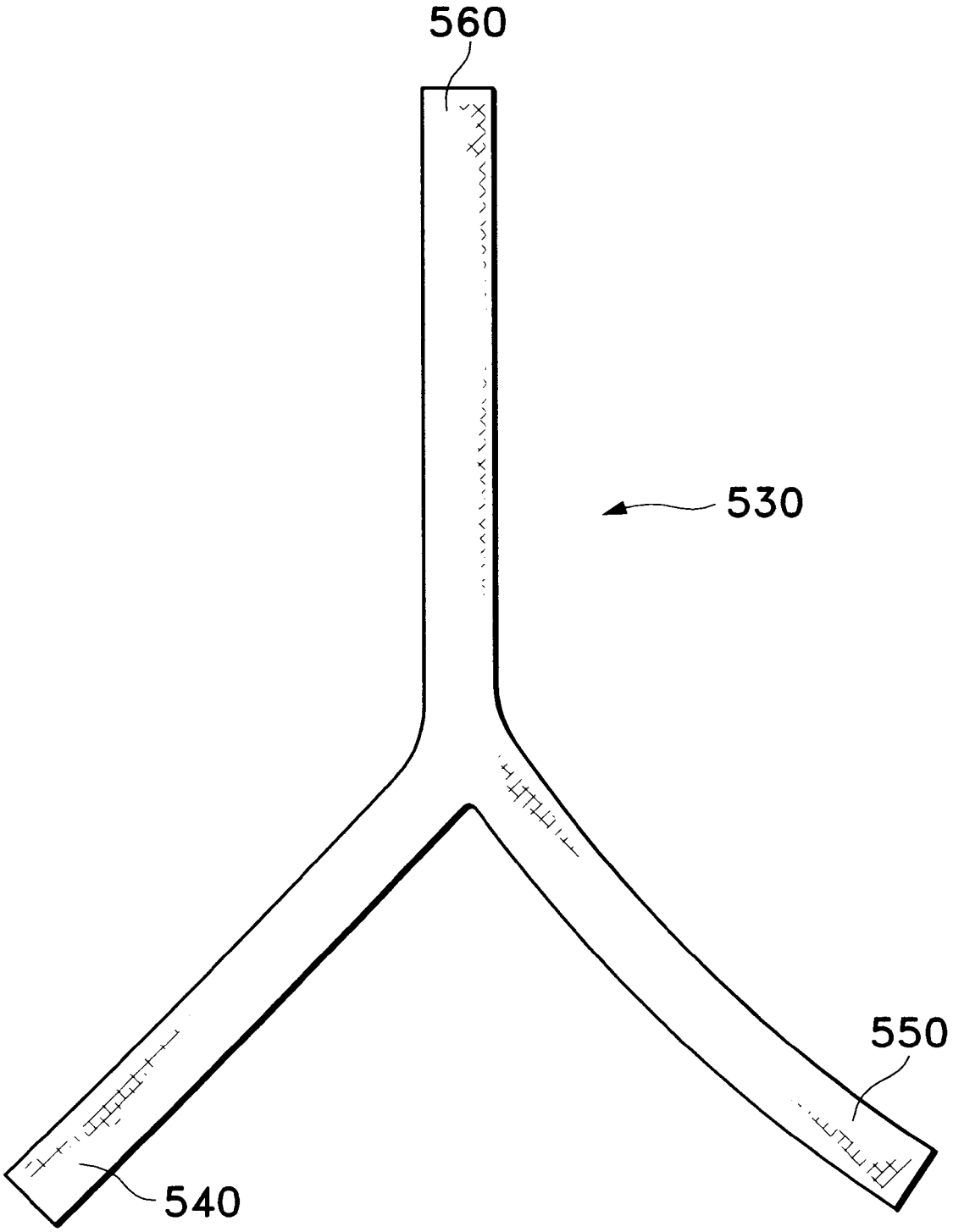
FIG. 3A is an alternative configuration for a bottom strap.

When a single bottom strap is used, one variation shown in FIG. 3A is suitable. Here, instead of having a single distal end as described above, strap 530 forms a "Y" by dividing into two distal ends 540 and 550, each of which connects to the distal end of right and left shoulder support members 300. Proximal end 560 of such a strap ideally will affix to body 200 at or near the fourth seam 218, approximately equidistant from each lateral panel 206. This helps to equally distribute the loads carried by each distal end 540 and 550 through the shoulder straps 300 and ensure that the shape of the bottom side 204 is as flat and symmetric as possible. Such a design has the added advantage of being aesthetically pleasing.

If more than two bottom straps are used, we prefer that they be in multiples of two, although this is not necessary (an odd number of bottom straps can be used as well). An even number, such as four, allows for their symmetric disposal about the bottom panel 204 and correspondingly symmetric load distribution.

One or more optional bottom support members 570 can be used to maintain the alignment of the bottom straps 500 adjacent bottom panel 204. Such a bottom support member can be removably or (preferably) permanently affixed to bottom panel 204 such as by sewing or the like.

Figure 4:
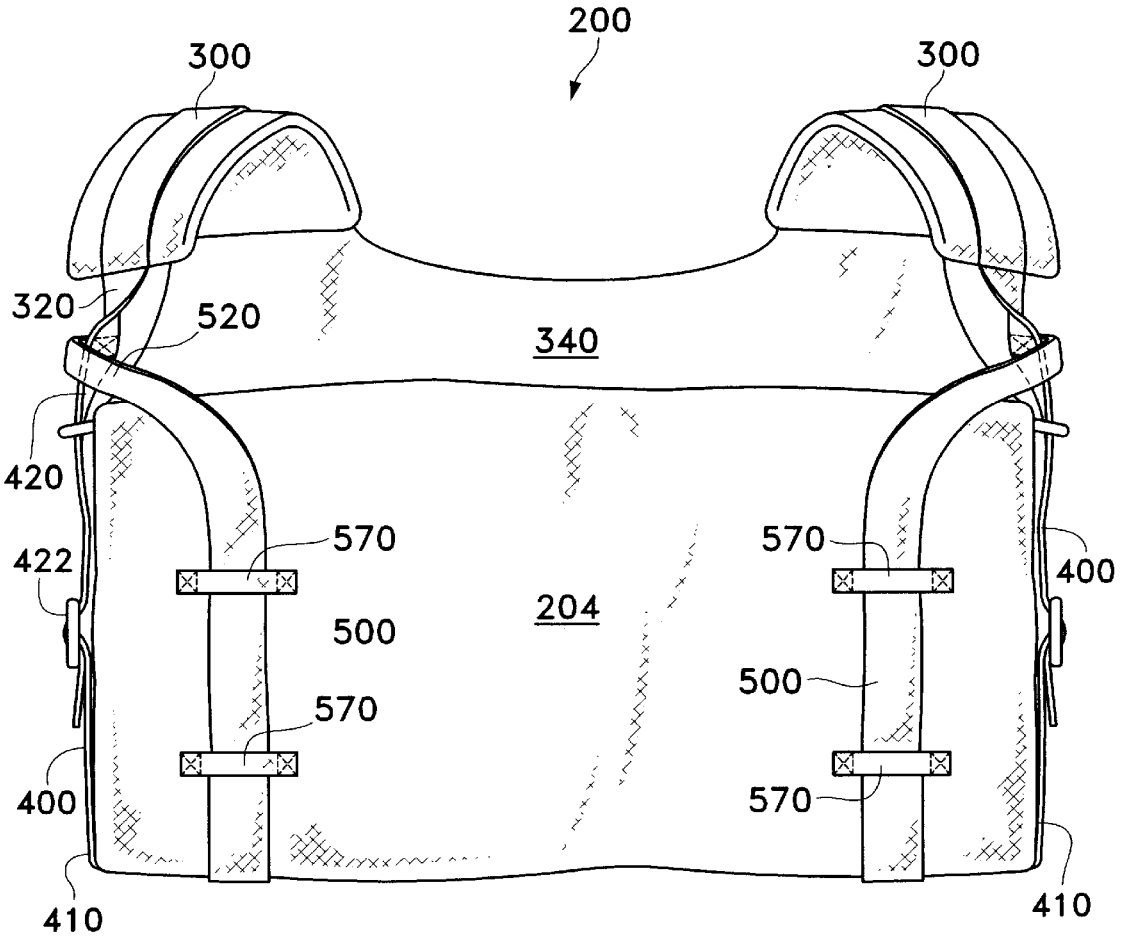
FIG. 4 is a bottom view of the bookpack of the present invention.
Figure 4A:
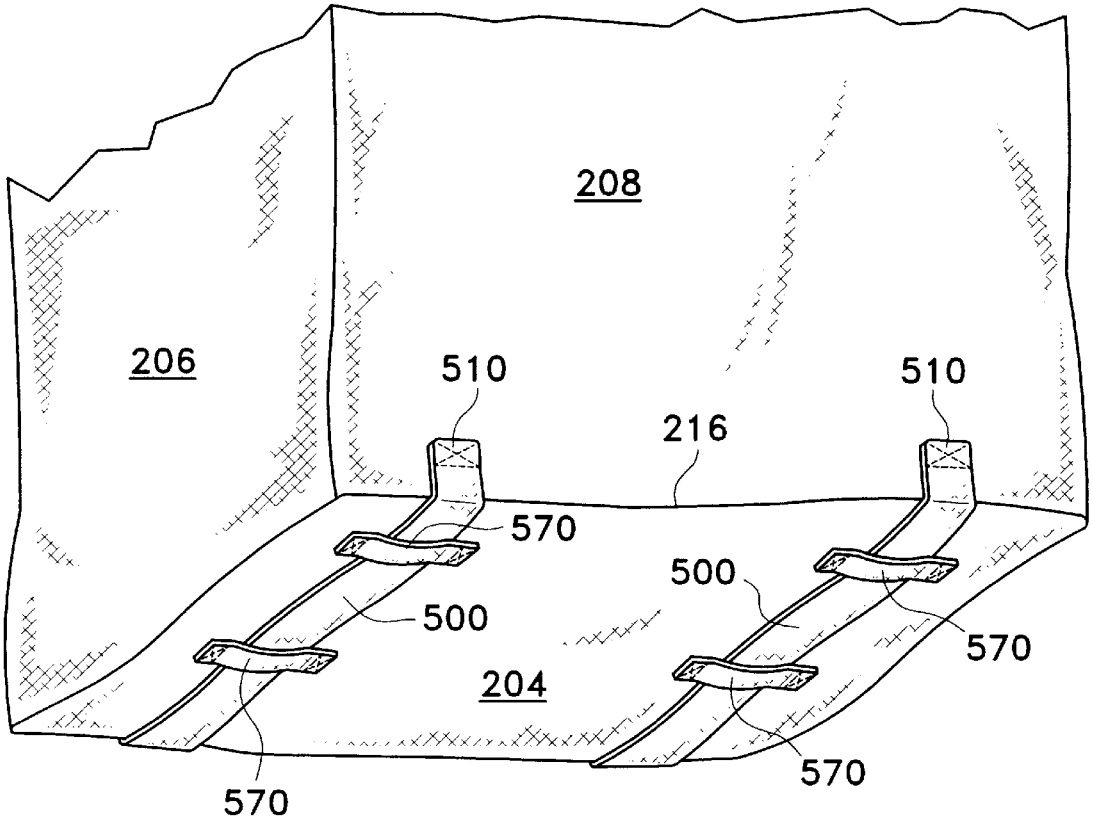
FIG. 4A is a perspective view of the bottom portion of the bookpack of the present invention.
Figure 5:
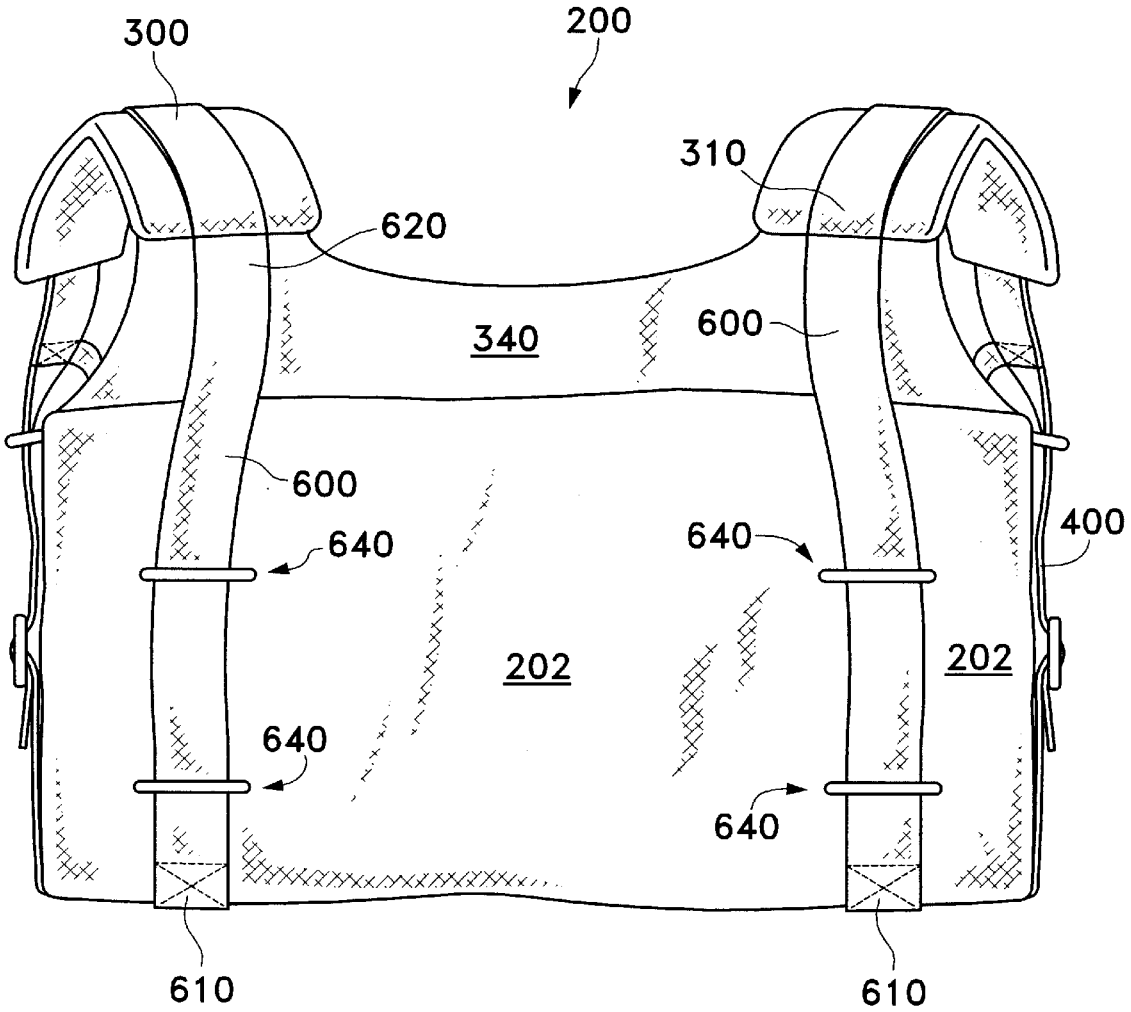
FIG. 5 is a top view of the bookpack of the present invention.

A variation of these support members is shown in FIGS. 4 and 4A. Here. four bottom support members 570, each comprising a length of Nylon strapping or other material, are affixed at their ends, such as by stitching or the like, to bottom panel 204 so that they generally are aligned with third scam 216. In this configuration, a gap is formed between each bottom support member 570 and the bottom panel 204. Each bottom strap 500 is threaded through this gap, as shown in FIG. 4A, and is thus kept within the confines of the support members 570. Note that the ends of each support member 570 shown in FIG. 4A can be moved together so that they overlap when affixed to bottom side 204. This forms a type of loop through which bottom strap 500 can be threaded.

In an alternative design (not shown), one end of bottom support member 570 can be sewn into bottom panel 204 and a ring or loop of material such as metal, Nylon, polyester thread, etc. can be formed in or attached to the other end of member 570. Bottom strap 500 can then be threaded through this ring or loop.

In addition to being a length of Nylon or other webbing or strapping material, bottom support member 570 can simply comprise multiple or solitary D-rings, clips, two-piece configurations with straps having adjustable buckles or clasps, etc. Such alternative configurations can be tailored to facilitate adjustability, flexibility, and strain relief as dictated by the design of the backpack and its particular performance requirements.

As shown in FIGS. 4 and 4A, we prefer that at least two bottom support members 570 be used for each bottom strap 500. However, less or more may be used depending upon the load designation, the number of bottom straps, aesthetic considerations, etc.

An additional optional feature of the invention is one or more top straps or members 600. FIGS. 3 and 7–9 show a configuration in which two such top straps are used.

Here, a proximal end or region 610 of each top strap 600 connects to the backpack body on or near a fourth juncture or seam 218 defined at the intersection of the outer side 208 and top side 204. Each top member 600 runs along the top panel and connects at its distal end 620 to the right or left shoulder support member 300 at a point distal to where shoulder strap 300 attaches to backpack body 200. For instance, in FIG. 3, top strap 600 attaches to shoulder strap 300 several inches from body 200. Top strap 600 may also attach to optional yoke 340. Generally, however, we prefer that the distal end 620 of top strap 600 attach to the shoulder support member 300 at a point approximating the uppermost portion of the wearer's shoulder when the backpack is fitted on a wearer. As will be described in detail below, this attachment point provides the most efficient and direct load transfer and helps to maintain an ideal square shape to the top of bookpack body 200.

Again, such connection points for both the proximal and distal ends of these top members 600 can be widely varied to serve the purposes which suit the particular design, and the invention is not so limited to the precise connection locations shown in the figures.

As discussed with respect to the bottom straps, a variety of configurations and numbers of top straps can be used in the present invention. For instance, a top strap having a "Y" configuration can be used, where each of two distal ends connects to each of the shoulder straps 300. In the case where more than one or two top straps is used, we prefer that the number of straps be even so to facilitate balanced load transfer and symmetry.

To assist in maintaining the square shape of the top of the bookpack body 200 and to keep the body 200 in towards the wearer's shoulders and relatively high, one or more optional minor straps or top support members 640 can be used in conjunction with top straps 600.

Such support members can have the variety of configurations and forms as described above with respect to bottom support members 840. Note a desirable configuration shown in FIGS. 3 and 7–8. In this embodiment, top support members 640 each has a proximal end 650 connected to top side 202 and a distal end 660 which is slidingly or permanently connected to the top strap 600 via an attached D-ring or similar loop.

Alternatively, a loop for the top strap 600 can be formed from the top support member material at its distal end 660, for instance by sewing the distal end over and onto itself. Of course, for this variation, the top support member 640 will be affixed to top side 202 so that the loop is oriented for receiving top strap 600; i.e., generally perpendicular to the arrangement of FIG. 3.

These and other top support member 640 arrangements, all of which are within the scope of the invention, help support the load borne by the wearer and assist the top straps in keeping the body 200 square at the top and keeping the bookpack high relative to the wearer's shoulders. Due to the downward force acting on the top support members 640, these members are placed under stress as they assist in bearing the load of body 200 at their distal end 648 where they engage top straps 600. It is therefore important that the point of connection between the distal end 660 of top support member 640 and top strap 600 be designed for durability and load-bearing functionality. This can be accomplished by reinforcing the top support member distal end 640 (by, e.g. affixing additional material), etc. In addition, a low-friction abrasion-resistant coating can be placed on either or both the distal end 640 and top strap 600 where they directly interface to prevent binding and to protect the materials from abrasion damage.

Figure 6:
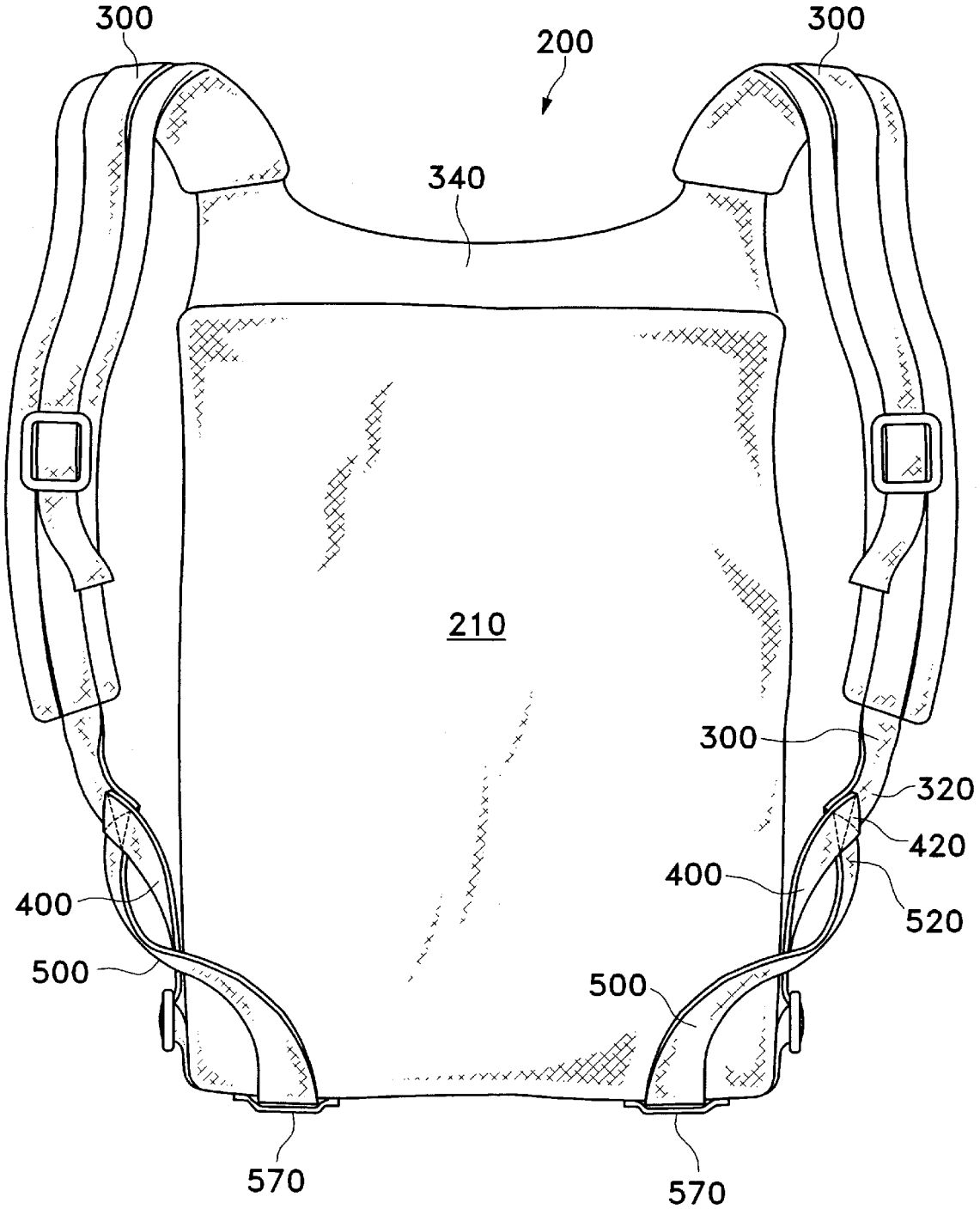
FIG. 6 is a body side elevation of the bookpack of the present invention.
Figure 6A:
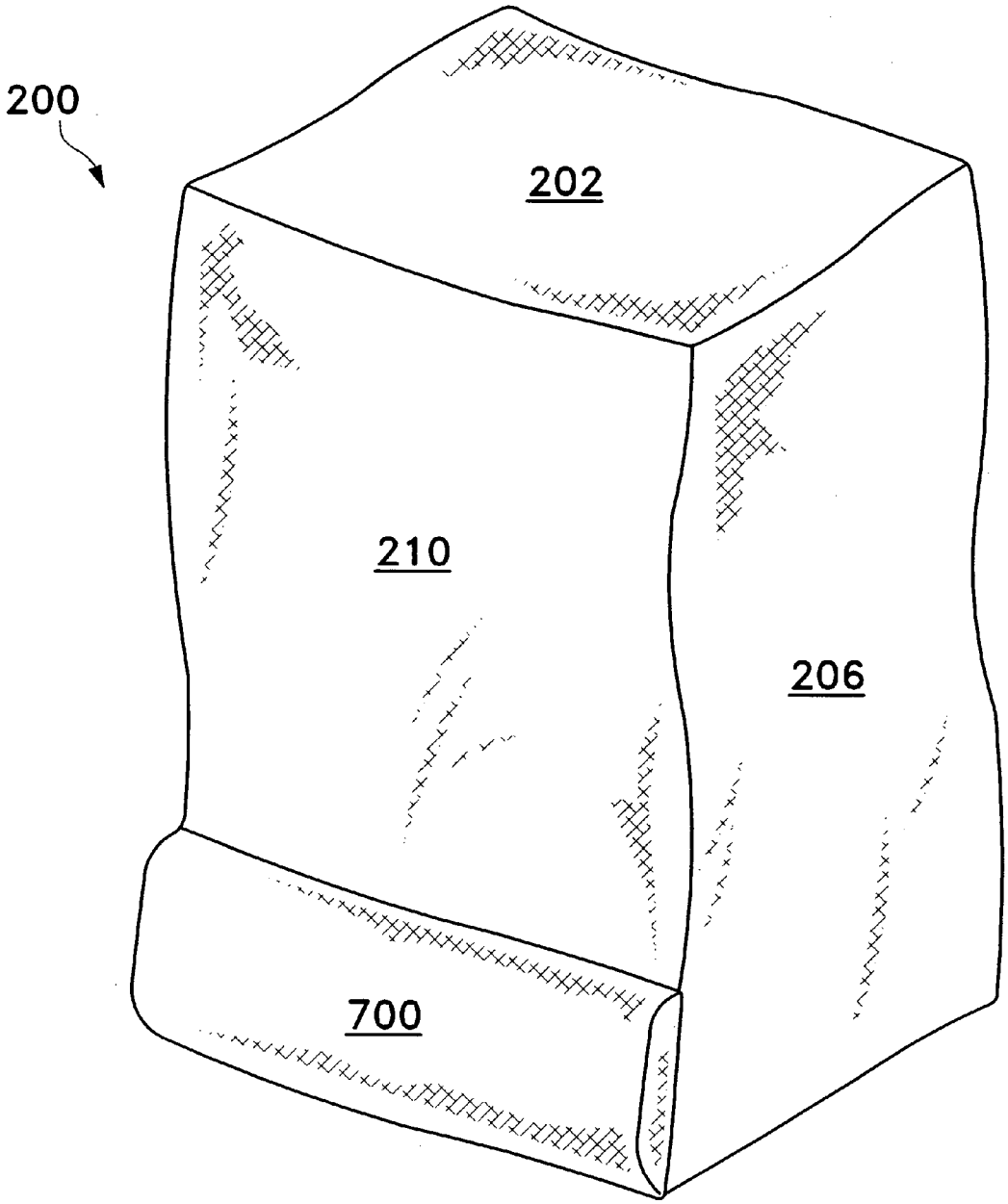
FIG. 6A is a simplified perspective view of the bookpack of the present invention with a lumbar pad.

FIG. 6A shows an embodiment where bookpack body 200 has an optional lumbar support member 700, which can take the form of padding or cushioning, such as polyurethane foam and the like (other features of the invention have been removed in FIG. 6A for clarity). Any type of padding or other support as is well-known in the art is appropriate.

For instance, lumbar support member 700 can be permanently (such as by sewing) or removably (such as by snaps, zipper, hook and loop fasteners. etc.) affixed to the body panel 210 so that it is disposed directly adjacent the wearer's lumbar region when worn.

In an alternative arrangement, a compartment or pouch affixed to or integrally formed as part of the panel forming the body side 210. A lumbar support member is formed when a pad or cargo serving as padding material (such as a towel) is inserted into this compartment prior to wearing the backpack. In this manner, the lumbar support member is an optional feature that can be selectively created and tailored by the wearer. When such a pad is no longer needed, the contents of the sleeve can be removed and the body 200 of the bookpack operates as if no lumbar pad existed.

Although it is not shown in the figures, this invention may also include a waist or hip belt attached to lumbar pad 700, backpack body 200, or even side straps 400 or bottom straps 500, singly or in combination as needed. Such a waist belt provides added support and helps transfer the load caused by the contents to the pelvic region of the wearer. Especially useful is a configuration where the waist belt is connected at its distal and proximal ends to the lower end of bookpack body 200 in the vicinity of the intersection of side panel 204 and body panel 206. It is also useful for the hip belt to be comprised of two pieces, one end of each connected to the bookpack body 200 as described, and the other ends of each strap connectable to one another by a conventional plastic or metal clasp or buckle, hook and loop-type fasteners, etc. as are well-known in the art. This hip belt can be adjustable for a proper fit.

There may be instances where it is desirable to be able to view the contents of the bookpack body 200 without having to open compartments and inspect the body interior. For instance, it may be that the owner of the bookpack is a child student and the parent wishes to be able to see what the child is carrying to school. Concerns about security by school, airport, or stadium officials may be satisfied with such a bookpack as its contents are readily inspectable. In some cases, such as schools, such a feature may be mandatory given heightened security measures in the wake of the well-publicized and tragic instances of school violence.

Figure 8:
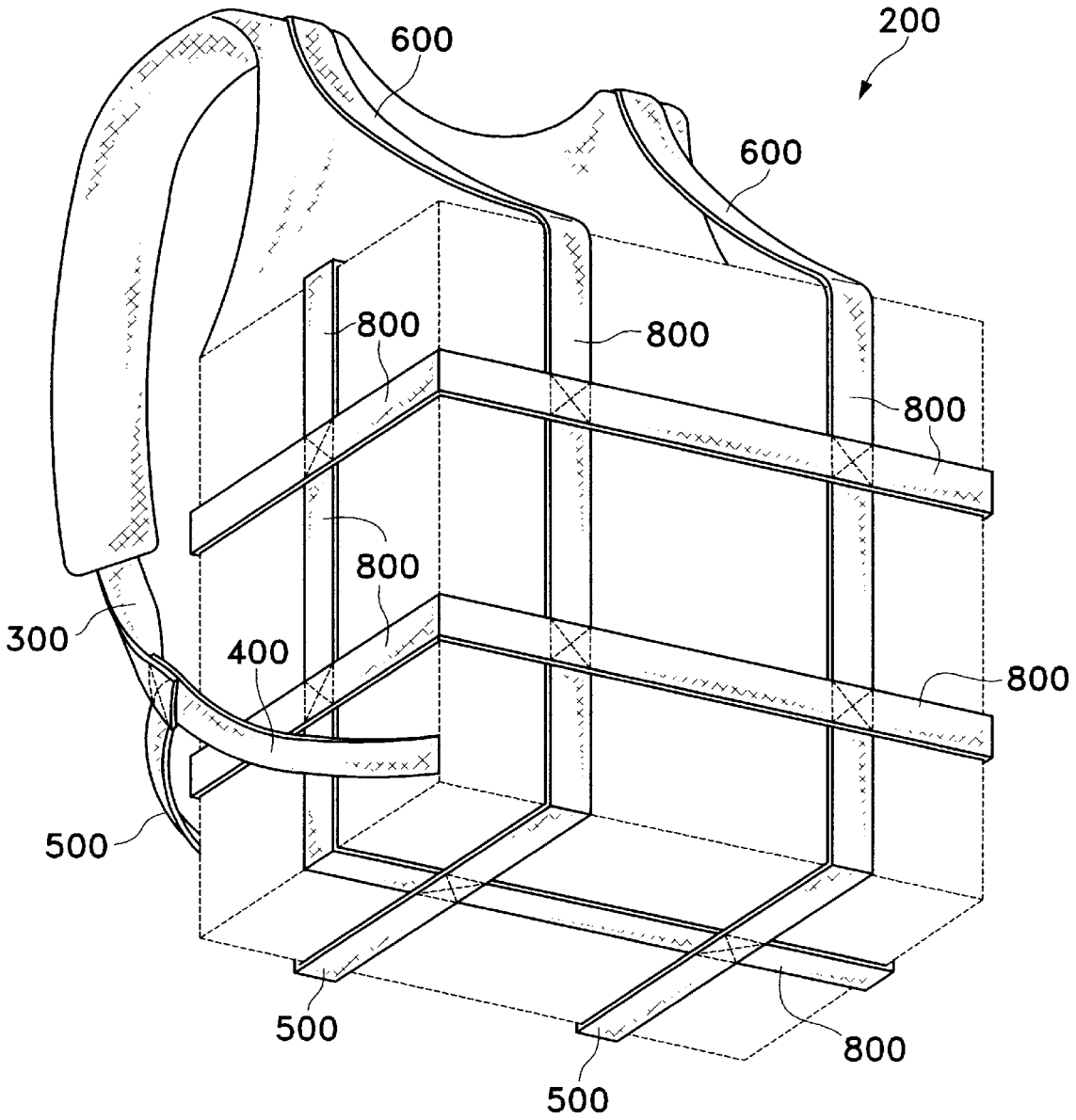
FIG. 8 is a perspective view of a transparent body version of the bookpack of the present invention.

FIG. 8 depicts an embodiment of the invention containing this "see-through" feature. Here, the top, bottom, lateral, outer, and body side panels as shown in the previous figures have been replaced with strapping 800 to form the body 200 of the backpack. Such strapping 800 is strong enough and wide enough to provide the carrying capability and durability required of the bookpack, yet afford enough space between straps so to allow one to readily view (and access) the contents of the backpack without opening a compartment.

Note that the outlined margins of the backpack are depicted in FIG. 8 to represent approximate boundaries of the backpack, and not a physical portion of the body 200 itself. Note also that the various components of the automatic suspension system, such as shoulder straps 300, top straps 600, bottom straps 500, and side straps 400 are still present, thus affording the wearer the same advantages of the ergonomic backpack but with a see-through body 200.

As previously discussed, straps 800 comprising the backpack body 200 can be made of the same material used for the body panels or the other straps; alternatively, they may be reinforced via high-performance fibers and the like to enhance their load-carrying capacity. Straps 800 depicted in FIG. 8 can take on a variety of thicknesses, widths, material forms, attachment methods, patterns (such as the linear crossing pattern shown in FIG. 8), strap spacing, alignment, etc. As long as the straps securely hold and protect the bookpack contents in the interior compartment while allowing one to view those contents from the outside, any strapping configuration is appropriate. One advantage of this configuration is the ability to place and access a relatively small bag or piece of luggage; e.g., airline carry-on luggage, inside the compartment formed by straps 800 such that the luggage handles or straps may be accessible through a gap or gaps in straps 800. This provides a convenient way for the wearer to carry the luggage on their back while still being able to conventionally carry the luggage by its own handle while the luggage is still inside the backpack compartment.

In addition, straps 800 can be replaced with a webbing or mesh material that allows light to penetrate through so that the contents of the body 200 are visible to the human eye without undue straining or inspection.

Instead of replacing the various panels as shown in FIG. 2 with the strapping 800 as shown in FIG. 8, the panels can also be comprised, partially or completely, of a continuous but transparent or translucent thermoplastic film or layer such as acrylic, cellulose, fluoroplastic, phenoxy, ionomer, rapidly-cooled polyamides such as Nylon 6 and Nylon 6, 6, polycarbonate, the polyolefins such as polyethylene, polystyrene, or other material that allows objects or contents of the body 200 to be visible from the outside.

Note that to allow the contents of the bookpack body 200 to be visible to the human eye, it is not necessary that the body side 210 or bottom 204 be transparent. For instance, any portion of the bookpack aligned with the wearer's back, such as body side 210, will by necessity be blocked by the wearer's body when viewed from the front. Thus, there is obviously no need for body side 210 to be adapted for see-through viewing. Likewise, it is typically unlikely that the bottom side 204 of body 200 need be transparent.

Figure 9:
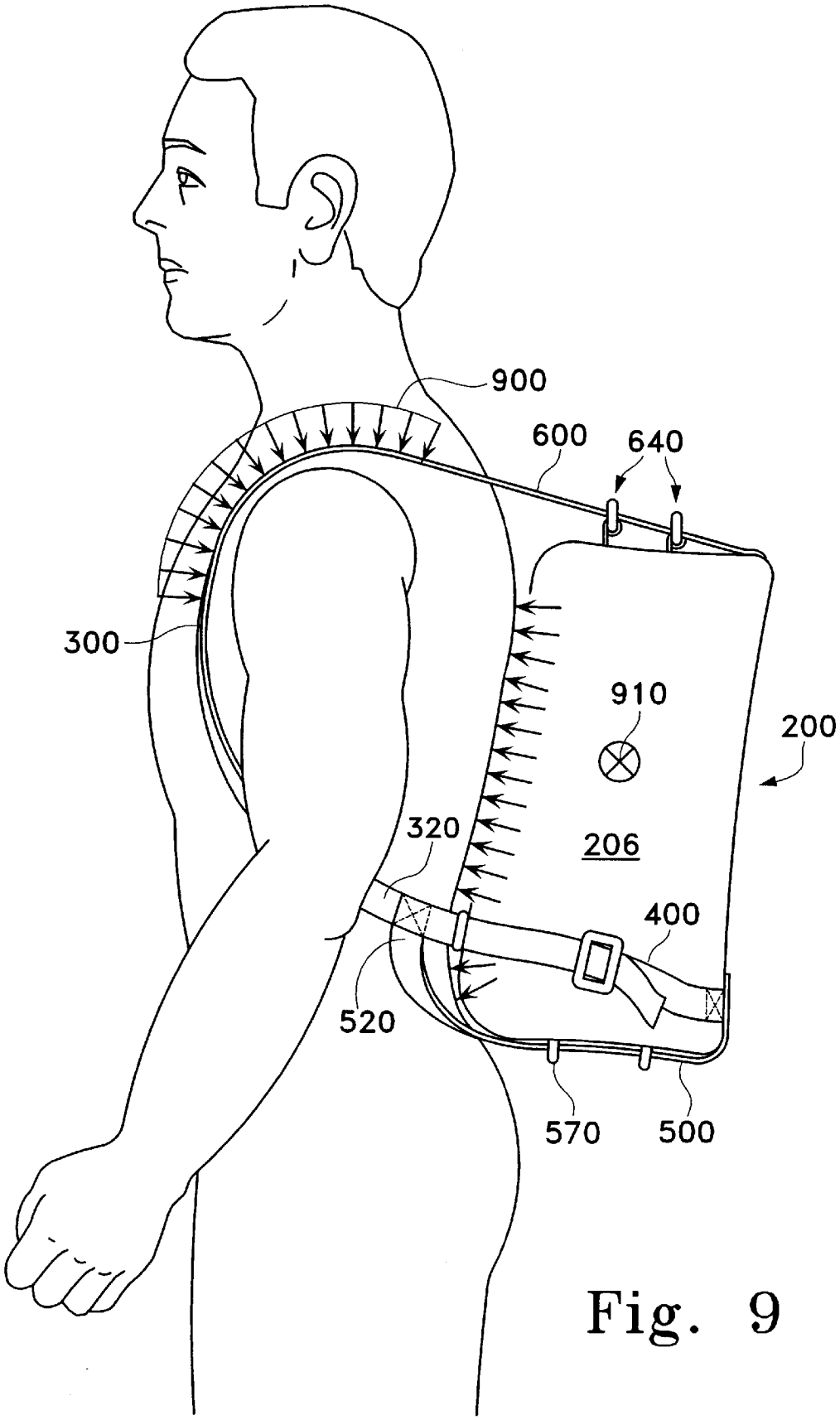
FIG. 9 is a side elevation of the bookpack of the present invention when worn.

On the other hand, and as shown in FIG. 9 for the bottom side 204, it is not absolutely necessary that such a transparent embodiment contain a conventional bottom side 204 or body side 210. This logic can also be extended such that any combination of transparent or see-through panels and conventional opaque panels is within the scope of the invention.

It should also be noted that a particular side or panel can contain both opaque and transparent sections. For instance, if a small window of clear plastic is built into conventional opaque Nylon lateral panel 206, the purposes of the invention are well-served.

FIG. 9 shows one configuration of the invention on a wearer. In use, a wearer would either load the interior compartment of the bookpack 200 with various contents or first strap the backpack on prior to loading.

In either event, when putting on the bookpack, the wearer will first place their left and right arm through gap between the body 200 and the appropriate left or right shoulder support members 300, adjusting them to bring the body 200 as close to the wearer's back as possible without being uncomfortable. If present, adjustable sternum strap can be connected and adjusted as well.

Next, side straps, bottom straps, and top straps, if present, are each adjusted for optimum comfort and functionality using any one of various adjustment devices as are well-known in the art. When the various adjustment means have made, the full advantages of the invention are realized.

Note that the load borne by the wearer through the shoulder straps 300, idealized as a distributed load 900 spanning the shoulder and chest area, is more evenly spread throughout the length of straps 300 than the conventional backpack of FIG. 1.

Such an even weight distribution is a direct function of the various features and advantages of the present design. Each of the various top straps, side straps and bottom straps act not only to move the CG 910 up and in towards the wearer's body, but they each significantly redistribute the load borne by the wearer's shoulders via the shoulder straps 300 along a longer portion of the wearer's body and back as well.

Figure 7:
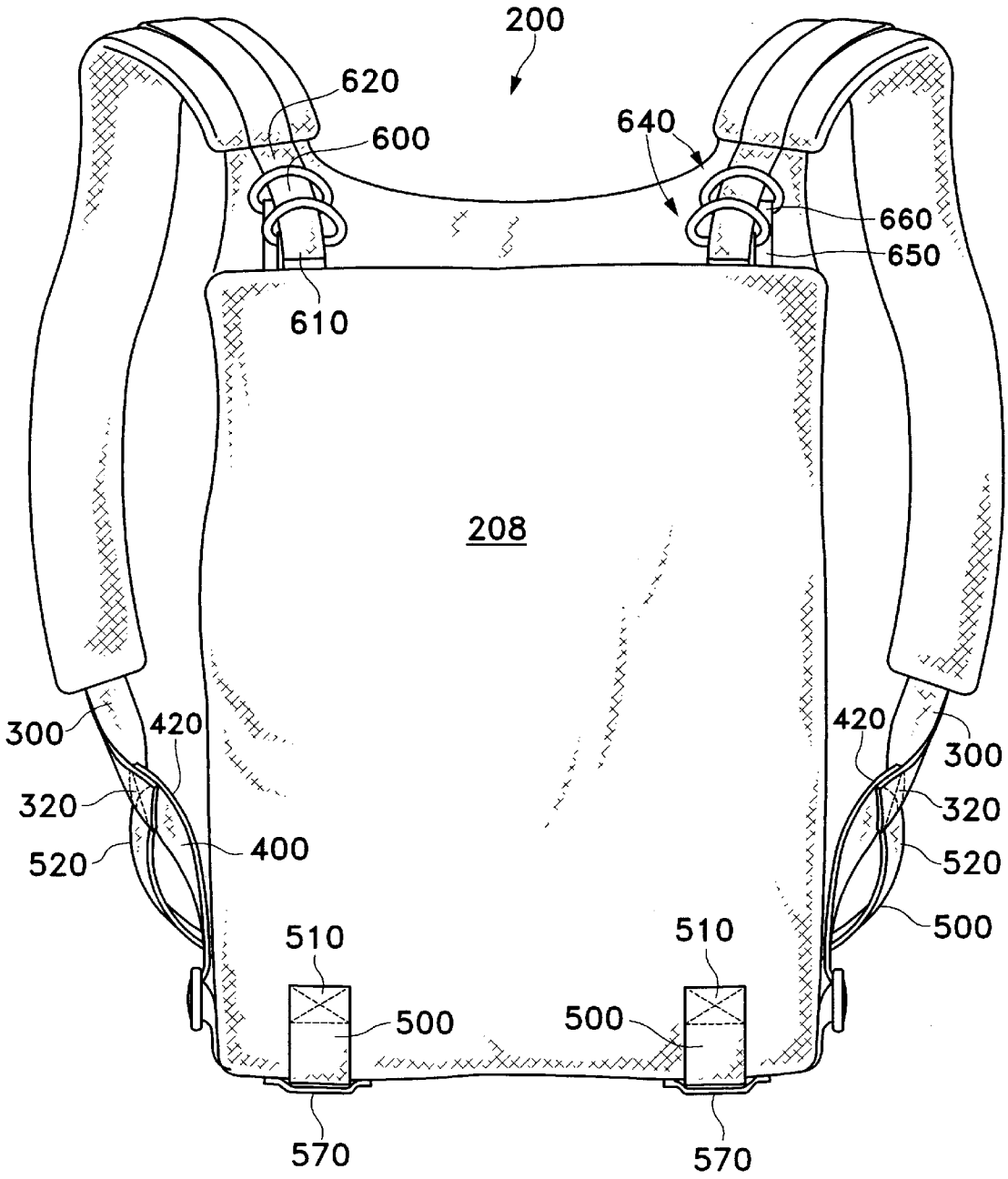
FIG. 7 is an outer side elevation of the bookpack of the present invention.

In particular, and as shown in FIG. 7, side straps 400, connected through their distal ends 420 to the distal ends of shoulder straps 300, act to redirect the load of the bookpack body 200 in the direction of the side straps 400. The CG 910 is now located between the wearer's body and second seam 214 where the side member proximal end 410 of strap 400 attaches to bookpack body 200, redirecting the load in the direction of the straps 400. Accordingly, the "hinge point" of conventional bookpacks is effectively removed. This helps to distribute the weight of the bookpack more evenly around the strap and across the back as shown in FIG. 9.

The rigid bottom, either by way of a bottom side 204 having a higher stiffness than the other panels, or by way of (or in addition to) a bottom strap or member 500, also adds to the functionality of the present invention. As previously discussed, a rigid body bottom helps to maintain the square shape of the bookpack body 200 by lifting and directing the load towards the wearer's body and shoulders. In addition, side straps 400 also serve to increase the overall rigidity of the lower portion of the backpack body 200, and works quite effectively in conjunction with the rigid bottom to serve this purpose.

By attaching the distal end 520 of the bottom strap 500 to the distal end 320 of shoulder strap 300 a portion of the load borne by the wearer through this connection point is distributed to the bottom strap 500. This serves to keep the shoulder strap 300 from cinching up under the wearer's arm, enhancing the wearer's load-carrying capability and overall comfort.

It is understood that the above advantages of the rigid bottom can be realized alone or in enhanced fashion when operating in conjunction with bottom support members 570.

Finally, top straps or members 600, working alone or in conjunction with top support members 640, act through its point of attachment at or near the fourth juncture to keep the bookpack body 200 square along the top. They also redirect the forces acting on the shoulder straps 300 along the top straps 600, again reducing the load placed on the wearer's shoulders.

These features create an automatic suspension system in which the center of gravity of the backpack is moved higher and closer to the wearer's body, and the load borne by the wearer's shoulders is redistributed along a longer portion of the wearer's body and back. Such a system allows the wearer to realize the advantages of the system by carrying more weight for longer periods of time with less discomfort, pound-for-pound experienced with conventional bookpacks.

This invention has been described and specific examples of the invention have been portrayed. The use of those specific examples is not intended to limit the invention in any way. Additionally, to the extent that there are variations of the invention which are within the spirit of the disclosure and yet are equivalent to the inventions found in the claims, it is our intent that those claims cover those variations as well.

What is claimed is:

1. An ergonomic backpack comprising:

a backpack body having a top side, a bottom side, two lateral sides, a body side, and an outer side, at least two shoulder support members, each shoulder support member having a distal end and a proximal end, the shoulder support member proximal end connected to the backpack body at a first juncture between the top side and the body side, and at least one side support member disposed adjacent one of the lateral sides and having a proximal end connected to the backpack body at a second juncture between the outer side and one of the lateral sides and a distal end connected to one of the shoulder support members.

2. The backpack of claim 1 where at least one of the top side, the bottom side, the two lateral sides, the body side, and the outer side is at least partially transparent.

3. The backpack of claim 2 where at least one of the top side, the bottom side, the two lateral sides, the body side, and the outer side comprises a mesh.

4. The backpack of claim 2 where at least one of the top side, the bottom side, the two lateral sides, the body side, and the outer side comprises one or more straps.

5. The backpack of claim 1 additionally comprising a bottom member having (1) a proximal end connected to the backpack body at a third juncture between said outer side and said bottom side, and (2) two distal ends, each distal end connected to the distal end of each shoulder support member.

6. The backpack of claim 5 additionally comprising at least one bottom support member having, a proximal end connected to the bottom side and a distal end connected to the bottom member.

7. The backpack of claim 1 additionally comprising two bottom members, each bottom member having (1) a proximal end connected to the backpack body at the third juncture, and (2) a distal end connected to the distal end of each shoulder support member.

8. The backpack of claim 7 additionally comprising at least one bottom support member having a proximal end connected to the bottom side and a distal end connected to one of the bottom members.

9. The backpack of claim 1 additionally comprising a top member having (1) a proximal end connected to the backpack body at a fourth juncture between the top side and the outer side, and (2) two distal ends, each distal end connected to one of each of the shoulder support members.

10. The backpack of claim 9 additionally comprising at least one top support member having a proximal end connected to the top side and a distal end connected to the top member.

11. The backpack of claim 1 additionally comprising two top members, each top member having (1) a proximal end connected to the backpack body at the fourth juncture, and (2) a distal end connected to one of the shoulder support members.

12. The backpack of claim 11 additionally comprising at least one top support member having a proximal end connected to the top side and a distal end connected to one of the top members.

13. The backpack of claim 1 additionally comprising a lumbar support member disposed adjacent the body side.

14. The backpack of claim 1 additionally comprising a yoke disposed along the backpack body at the first juncture and connected to each shoulder strap.

15. The backpack of claim 1 additionally comprising a backpack body interior compartment and wherein items, when placed into the interior compartment, are visible to the human eye.

16. An ergonomic backpack comprising:

a backpack body having a top side, a bottom side, two lateral sides, a body side, and an outer side, at least two shoulder support members, each shoulder support member having a distal end and a proximal end, the shoulder support member proximal end connected to the backpack body at a first juncture between the top side and the body side, at least one side support member disposed adjacent one of the lateral sides and having a proximal end connected to the backpack body at a second juncture between the outer side and one of the lateral sides and a distal end connected to one of the shoulder support members, and at least one bottom member having a proximal end connected to the backpack body at a third juncture between the outer side and the bottom side, and at least one distal end connected to the distal end of one of the shoulder support members.

17. The backpack of claim 16 where at least one of the top side, the bottom side, the two lateral sides, the body side, and the outer side is at least partially transparent.

18. The backpack of claim 16 where the bottom side has a higher stiffness than the top side, the two lateral sides, the body side, and the outer side.

19. An ergonomic backpack comprising:

a backpack body having an interior compartment, a top side, a bottom side, two lateral sides, a body side, and an outer side, a pair of shoulder straps, each shoulder strap having a distal end and a proximal end, the proximal end connected to the backpack body at a first juncture between the top side and the body side, a pair of side straps, each side strap disposed adjacent one of the lateral sides and having a proximal end connected to the backpack body at a second juncture between one of the lateral sides and the outer side, and a distal end connected to one of the shoulder support members, and a pair of bottom straps, each bottom strap having a proximal end connected to the backpack body at a third juncture between the outer side and the bottom side and a distal end connected to each of the shoulder strap distal ends, each bottom strap at least partially disposed adjacent the bottom side, at least one bottom support strap having a proximal end connected to the bottom side and a distal end connected to one of the bottom straps, a pair of top straps, each top strap having a proximal end connected to the backpack body at a fourth juncture between the top side and the outer side and a distal end connected to each of the shoulder support straps, at least one top support strap having a proximal end connected to the backpack body top side and a distal end connected to one of the top straps, and a lumbar support member disposed adjacent the body side.

20. The backpack of claim 19 wherein items, when placed into the interior compartment, are visible to the human eye.

* * * * *